US008528128B2

(12) United States Patent
Wang

(10) Patent No.: US 8,528,128 B2
(45) Date of Patent: Sep. 10, 2013

(54) CLOSURE DEVICE FOR DRAIN PIPELINE

(76) Inventor: Yung-Hui Wang, Jiali Township, Tainan County (TW)

( * ) Notice: Subject to any disclaimer, the term of this patent is extended or adjusted under 35 U.S.C. 154(b) by 523 days.

(21) Appl. No.: 12/945,933

(22) Filed: Nov. 15, 2010

(65) Prior Publication Data

US 2012/0117721 A1 May 17, 2012

(51) Int. Cl.
*E03C 1/23* (2006.01)

(52) U.S. Cl.
USPC ..... 4/688

(58) Field of Classification Search
USPC ..... 4/286, 295, 688
See application file for complete search history.

(56) References Cited

U.S. PATENT DOCUMENTS 1,137,516 A * 4/1915 Moon ..... 137/247.15
5,601,112 A * 2/1997 Sekiya et al. ..... 137/512.15
6,273,124 B1 * 8/2001 Huber et al. ..... 137/362

* cited by examiner

*Primary Examiner* — Huyen Le
(74) *Attorney, Agent, or Firm* — Alan Kamrath; Kamrath IP Lawfirm, P.A.

(57) ABSTRACT

A closure device for a drain pipeline includes an outer sleeve, an inner sleeve mounted in the outer sleeve, and a closure member. The outer sleeve is adapted to be installed between a drain of a sink or washbasin and a drainpipe. A flow port is defined in the inner sleeve. The closure member is movably supported in the inner sleeve in a vertical direction. The closure member is normally biased by a spring to close the flow port so as to block odor from flowing into an indoor space, and the closure member is moved downwards to open the flow port when draining water into the outer sleeve.

5 Claims, 8 Drawing Sheets

CLOSURE DEVICE FOR DRAIN PIPELINE

BACKGROUND OF THE INVENTION

1. Field of the Invention

The present invention relates to a closure device for a drain pipeline and, more particularly, to a closure device suitable for mounting between a drain of a sink or washbasin and a drainpipe.

2. Description of the Related Art

The drain opening of a sink or washbasin is mostly installed with a drain to prevent sundries from flowing into a drainpipe of the sink or washbasin. However, the drain is not closed, and odor generated from dirt accumulated within the drainpipe will flow through the drain opening into an indoor space. In addition, pests such as cockroaches and mosquitoes might also climb into the indoor space through the drain, which might lead to the lowering of the environment hygiene quality of the indoor space.

The sink drain may be installed with a conventional closing device for blocking odor and pests. However, the sundries and residues in the discharged water are usually stopped by the closing device and get accumulated within the sink drain, leading to plugging of the pipeline. Further, cleaning of the sundries and residues in the closing device is always not easy. Furthermore, A U-shaped or S-shaped drain trap has been proposed for being mounted between the drain and the drainpipe of the sink or washbasin so that odor and pests can be prevented by the retained water in the U-shaped or S-shaped drain trap. However, if water is not discharged into the drain opening for a certain period of time, the water in the drain trap will get dried due to negative pressure in the drainpipe, and then the effect of blocking odor and pests will be lost. Further, it is troublesome to install the drain trap in existing drain pipelines.

BRIEF SUMMARY OF THE INVENTION

Thus, it is an objective of the present invention to solves this need and other problems in the field of blocking odor and pests in the pipeline by providing a closure device that is adapted to be installed between a drain of a sink or washbasin and a drainpipe so as to block the odor and the pests in the pipeline from flow into or entering the indoor space and to avoid the reverse flow of water in the drain pipeline.

To achieve the foregoing objective, a closure device of the present invention includes an outer sleeve, an inner sleeve mounted in the outer sleeve, and a closure member. The outer sleeve includes upper and lower ends spaced in a vertical direction. The upper end of the outer sleeve has an upper coupling opening for connecting with a drain of a sink or washbasin, and the lower end of the outer sleeve has a lower coupling opening for connecting with a drainpipe. The inner sleeve includes upper and lower sections spaced in the vertical direction. The upper section of the inner sleeve has an inner flange formed on an inner periphery of the upper section of the inner sleeve and defining a flow port. The inner sleeve is provided with a spring seat installed in the lower section of the inner sleeve, a guide extending from the spring seat toward the upper section of the inner sleeve in the vertical direction, and a spring mounted around the guide and including top and lower ends spaced in the vertical direction. The lower end of the spring abuts against the spring seat. The closure member is received in the inner sleeve and includes a closure portion and a tube portion extending upwards from the closure portion in the vertical direction. The closure portion is located between the spring seat and the inner flange of the inner sleeve and abuts against the upper end of the spring. The tube portion is mounted around an upper end of the guide. The closure member is moveable between a first position and a second position in the vertical direction. The spring biases the closure portion to close the flow port when the closure member is in the first position, and the closure portion is spaced from the inner flange to open the flow port when the closure member is in the second position.

In a preferred form, the closure device further includes a tubular lower connector having an upper end with an outer thread. The lower coupling opening of the outer sleeve has an inner thread, and the upper end of the lower connector is threadedly coupled with the lower coupling opening of the outer sleeve and abuts the lower section of the inner sleeve. The upper and lower sections of the inner sleeve are detachably coupled with each other to form the inner sleeve. The upper end of the outer sleeve includes an annular groove formed between an outer periphery of the upper end of the outer sleeve and the upper coupling opening of the outer sleeve. The upper section of the inner sleeve is engaged in the annular groove of the outer sleeve.

Preferably, the closure device further includes a tubular upper connector having a lower end with an outer thread. The upper coupling opening of the outer sleeve has an inner thread, and the lower end of the upper connector is threadedly coupled with the upper coupling opening of the outer sleeve.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
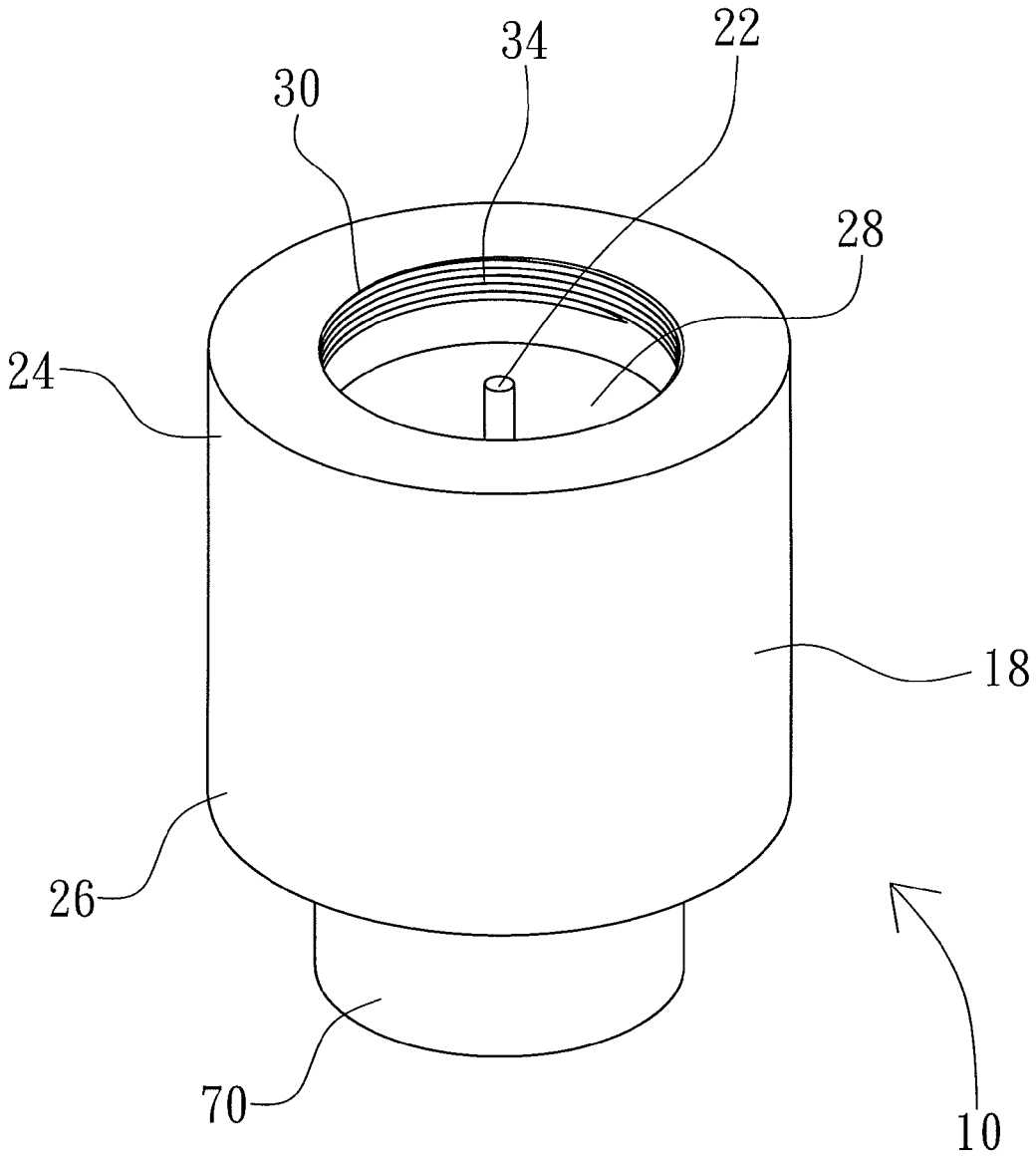
FIG. 1 shows a perspective view of a closure device for a drain pipeline according to the preferred teachings of the present invention.
Figure 2:
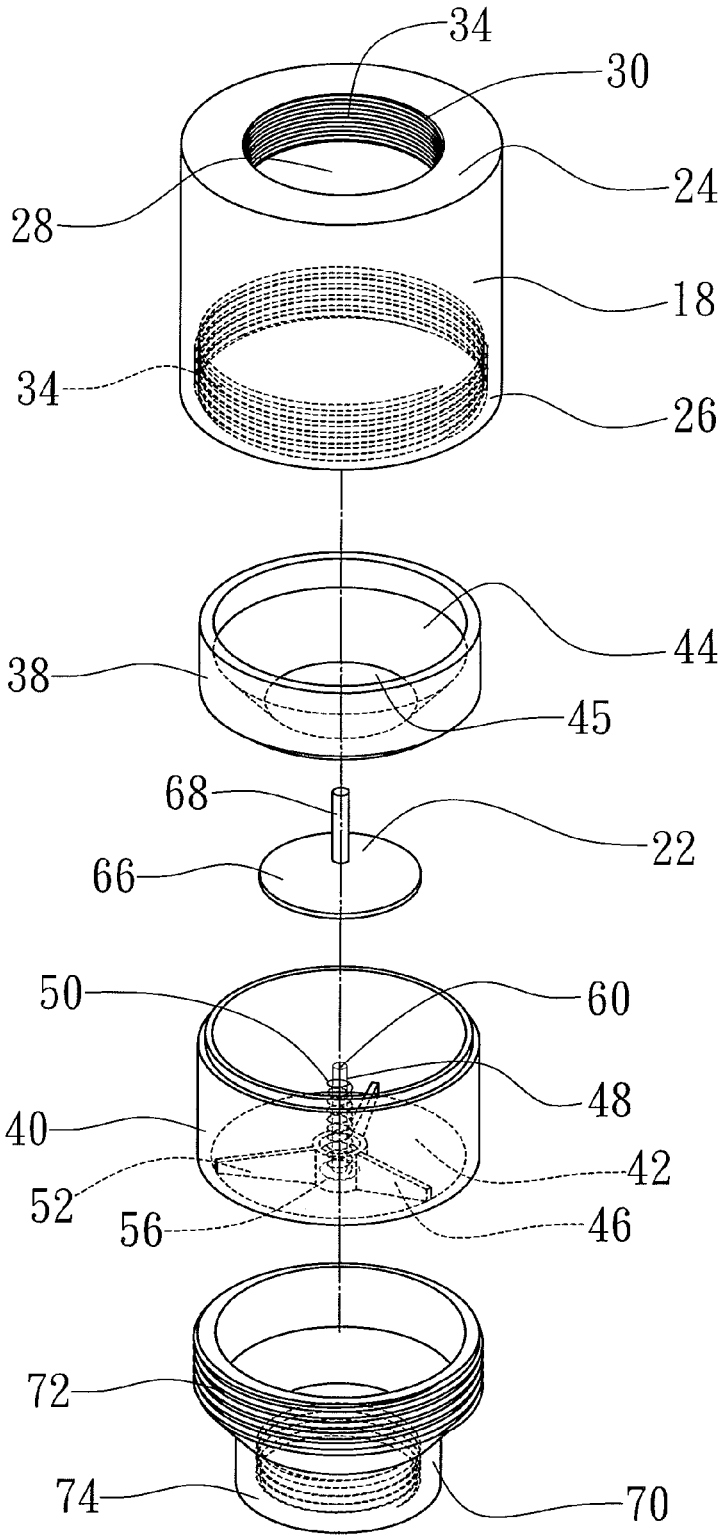
FIG. 2 shows an exploded, perspective view of the closure device of FIG. 1.
Figure 3:
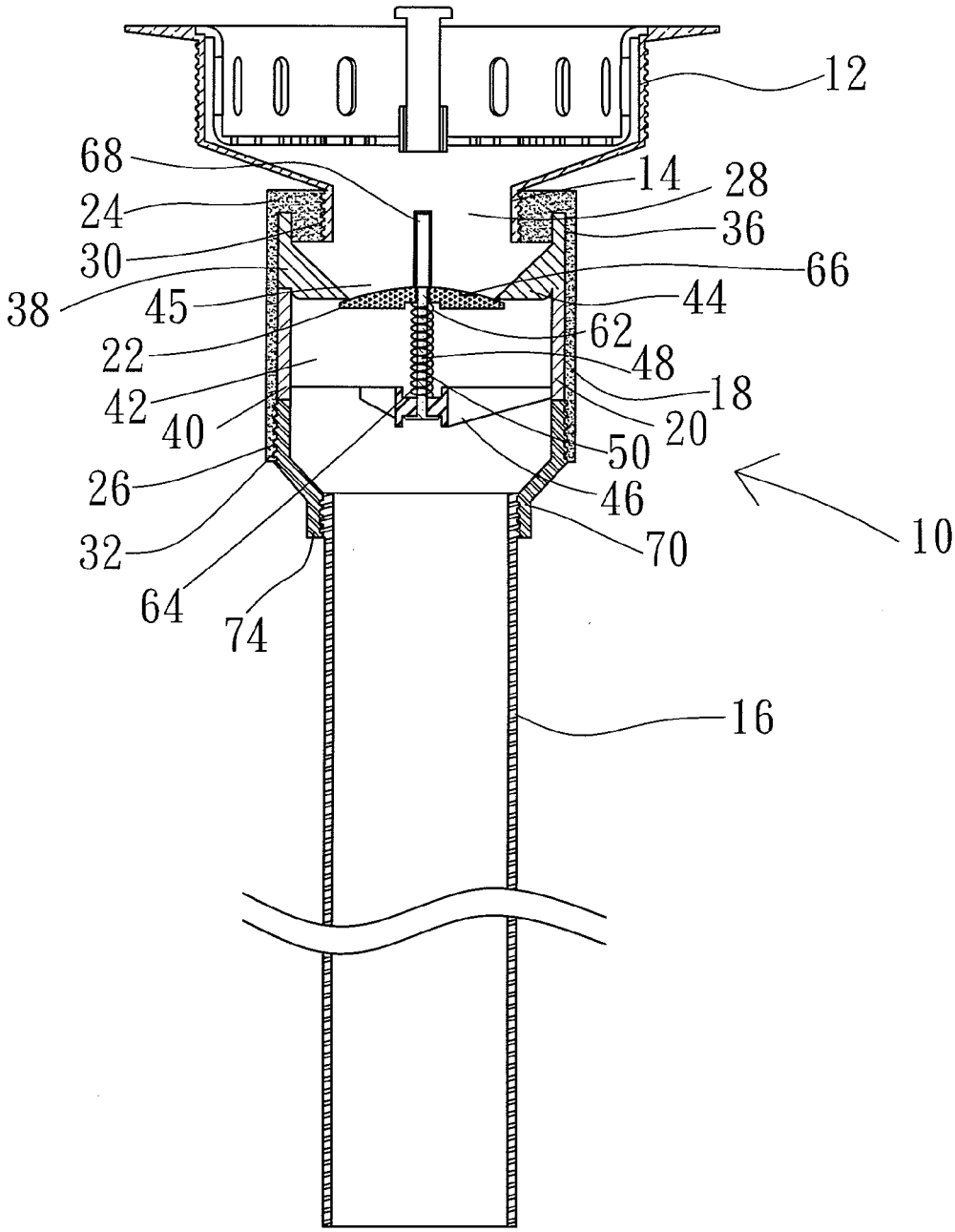
FIG. 3 shows a cross sectional view of the closure device of FIG. 1 with the closure device mounted between a bottom of a sink drain and a drainpipe.
Figure 4:
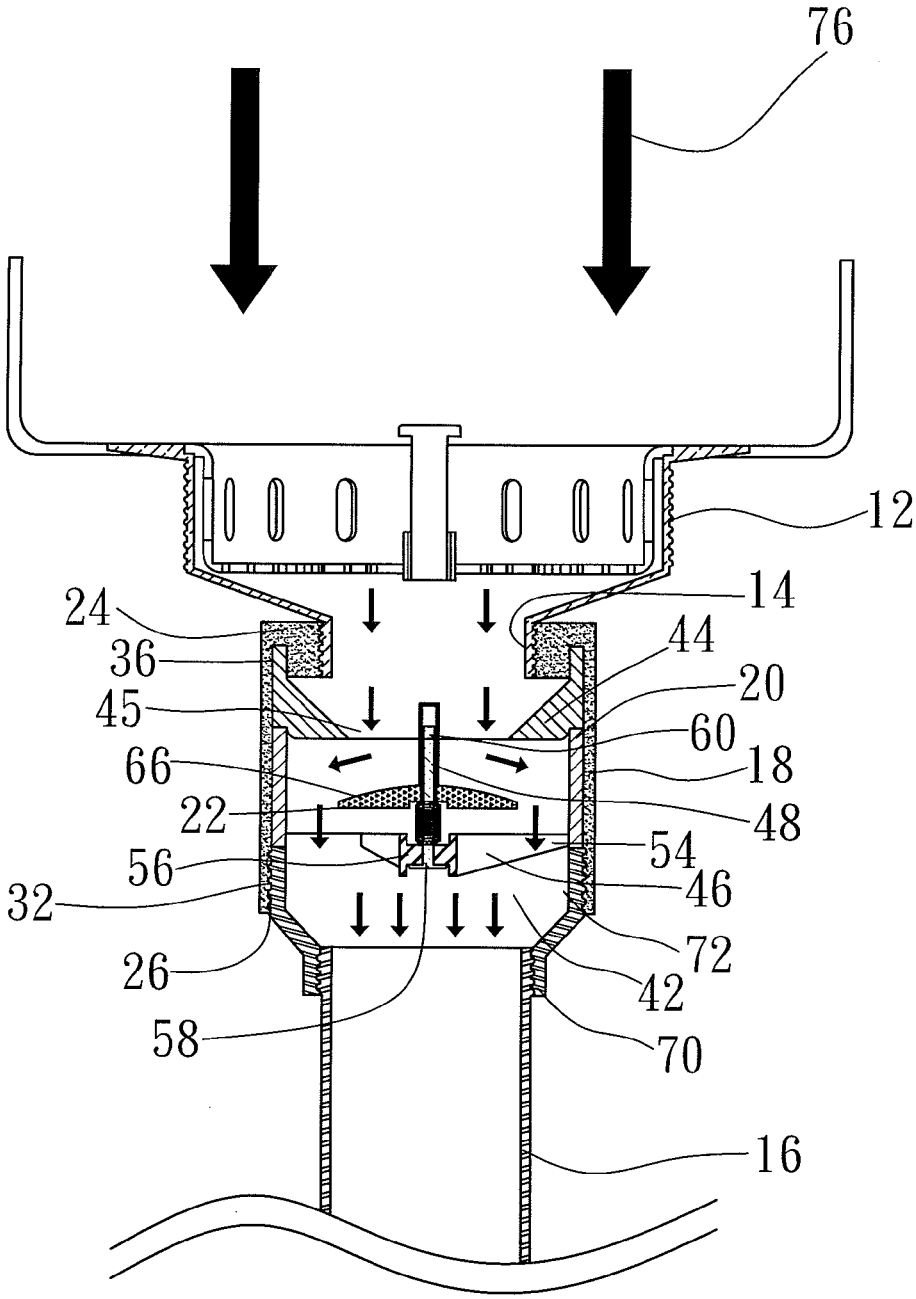
FIG. 4 shows a cross sectional view similar to FIG. 3, with a closure member of FIG. 3 moved downwards to open a flow port.

A closure device for a drain pipeline according to the preferred teachings of the present invention is shown in FIGS. 1 through 4 of the drawings and generally designated 10. The closure device 10 is adapted to be mounted between a bottom 14 of a sink drain 12 and a drainpipe 16. Closure device 10 includes an outer sleeve 18, an inner sleeve 20 mounted within outer sleeve 18, and a closure member 22 received in the inner sleeve 20. Outer sleeve 18 includes upper and lower ends 24 and 26 spaced in a vertical direction and a through-hole 28 extending from upper end 24 through lower end 26. Through-hole 28 of outer sleeve 18 includes an upper coupling opening 30 formed in upper end 24 and a lower coupling opening 32 formed in lower end 26. Upper and lower coupling openings 30 and 32 have inner thread 34 respectively. Upper coupling opening 30 is adapted to connect with the bottom 14 of sink drain 12. The upper end 24 of outer sleeve 18 is provided with an annular groove 36 formed between an outer periphery of upper end 24 of outer sleeve 18 and upper coupling opening 30.

Inner sleeve 20 includes upper and lower sections 38 and 40 spaced in the vertical direction and a through-hole 42 extending from upper section 38 through lower section 40. A top end of upper section 38 of inner sleeve 20 is engaged in the annular groove 36 of outer sleeve 18. According to the preferred form shown, each of upper and lower sections 38 and 40 is in the form of a sleeve body, and upper and lower sections 38 and 40 are detachably coupled with each other to form inner sleeve 20 so that closure member 22 can be easily installed within inner sleeve 20. Moreover, an annular inner flange 44 is formed on an inner periphery of upper section 38 of inner sleeve 20 and defines a flow port 45 therein. According to the preferred form shown, inner flange 44 has conical cross sections.

Inner sleeve 20 is provided with a spring seat 46, a guide 48, and a spring 50. Spring seat 46 is installed within lower section 40 of inner sleeve 20. In this embodiment, spring seat 46 includes three spaced supports 52 each of which includes an outer end 54 engaged to a hole wall of through-hole 42 of lower section 40 and an inner end 56 located at a center axis of through-hole 42 (see FIG. 4). The inner ends 56 of supports 52 are engaged together. Guide 48 extends from inner ends 56 of supports 52 towards upper section 38 of inner sleeve 20 in the vertical direction. According to the preferred form shown, guide 48 is a screw and includes a lower end 58 engaged to spring seat 46 and an upper end 60 located in upper section 38 of inner sleeve 20. Spring 50 is mounted around guide 48 and includes an upper end 62 and a lower end 64 abutting against spring seat 46.

According to the preferred form shown, closure member 22 includes a plate-shaped closure portion 66 and a tube portion 68 extends upwards from a top surface of closure portion 66. Closure portion 66 is located between spring seat 46 and inner flange 44 of inner sleeve 20 in the vertical direction. Closure portion 66 has an outer diameter smaller than that of through-hole 42 but larger than that of flow port 45. In assembly, closure member 22 is installed within lower section 40 of inner sleeve 20 first, and then upper section 38 of inner sleeve 20 is coupled to lower section 40 of inner sleeve 20. Closure portion 66 abuts on upper end 62 of spring 50 such that closure member 22 is moveable up and down in inner sleeve 20 between a first position and a second position in the vertical direction. Tube portion 68 of closure member 22 is put on upper end 60 of guide 48 to guide the ascending and descending motion of closure member 22. Closure portion 66 is biased by spring 50 to abut against a lower end of inner flange 44 so as to close flow port 45 when closure member 22 is in the first position, and closure portion 66 is spaced from inner flange 44 and compresses spring 50 to open flow port 45 when closure member 22 is in the second position.

According to the preferred form shown, closure device 10 further includes a tubular lower connector 70 having an upper end 72 with an outer thread and a lower end 74 with an inner thread. Upper end 72 of lower connector 70 is threadedly coupled with lower coupling opening 32 of outer sleeve 18 and abuts lower section 40 of inner sleeve 20 to position inner sleeve 20 in place. The lower end 74 of lower connector 70 is adapted to connect with drainpipe 16.

In practice of closure device 10, when water 76 is discharged into sink drain 12 (see FIG. 4), the weight of water 76 will press closure member 22 downwards so that closure member 22 is moved to the second position to open flow port 45, and water 76 can then be smoothly discharged into the drainpipe 16. On the other hand, closure member 22 is biased by spring 50 and moved to the first position to close flow port 45 when there is no water 76 to be discharged into sink drain 12 (see FIG. 3). Thus, flow port 45 is normally closed or sealed by closure member 22 to prevent flow of residual water in drainpipe 16 back into sink drain 12, and the odor and pests such as cockroaches in drainpipe 16 can be prevented from flowing into or entering the indoor space. Further, When there are too much sundries accumulated in closure device 10 to affect the water drainage, the user can easily disassemble closure device 10 for cleaning purposes.

Figure 5:
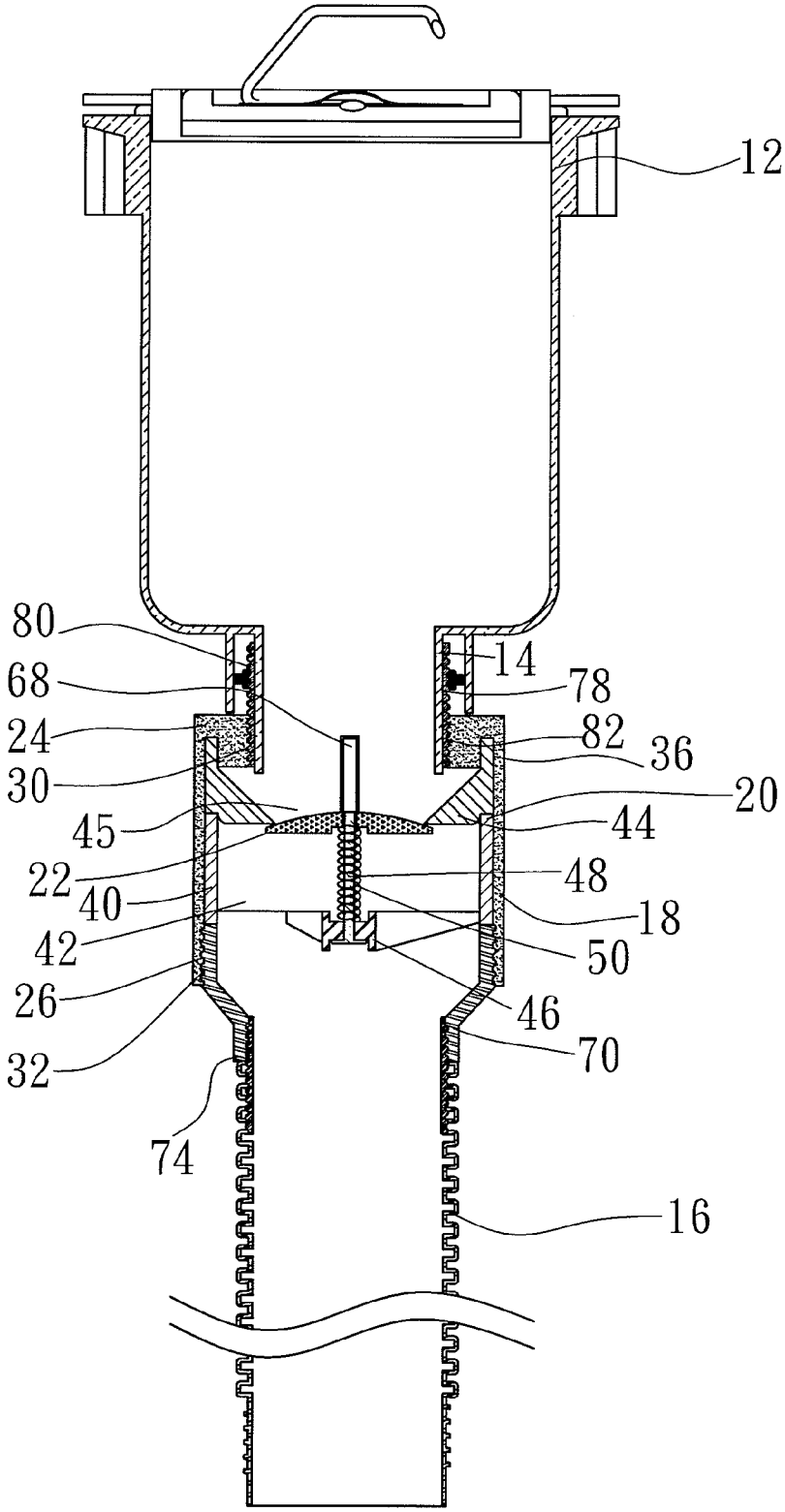
FIG. 5 shows a cross sectional view of a closure device of another embodiment according to the preferred teachings of the present invention, with the closure device applied to a drainpipe of another type of sink.

FIG. 5 shows that closure device 10 further includes a tubular upper connector 78 having an upper end 80 with an outer thread and a lower end 82 with an outer thread. Lower end 82 is threadedly coupled with upper coupling opening 30 of outer sleeve 18, and upper end 80 is connected with a lower end 14 of drain 12 of another type of sink.

Figure 6:
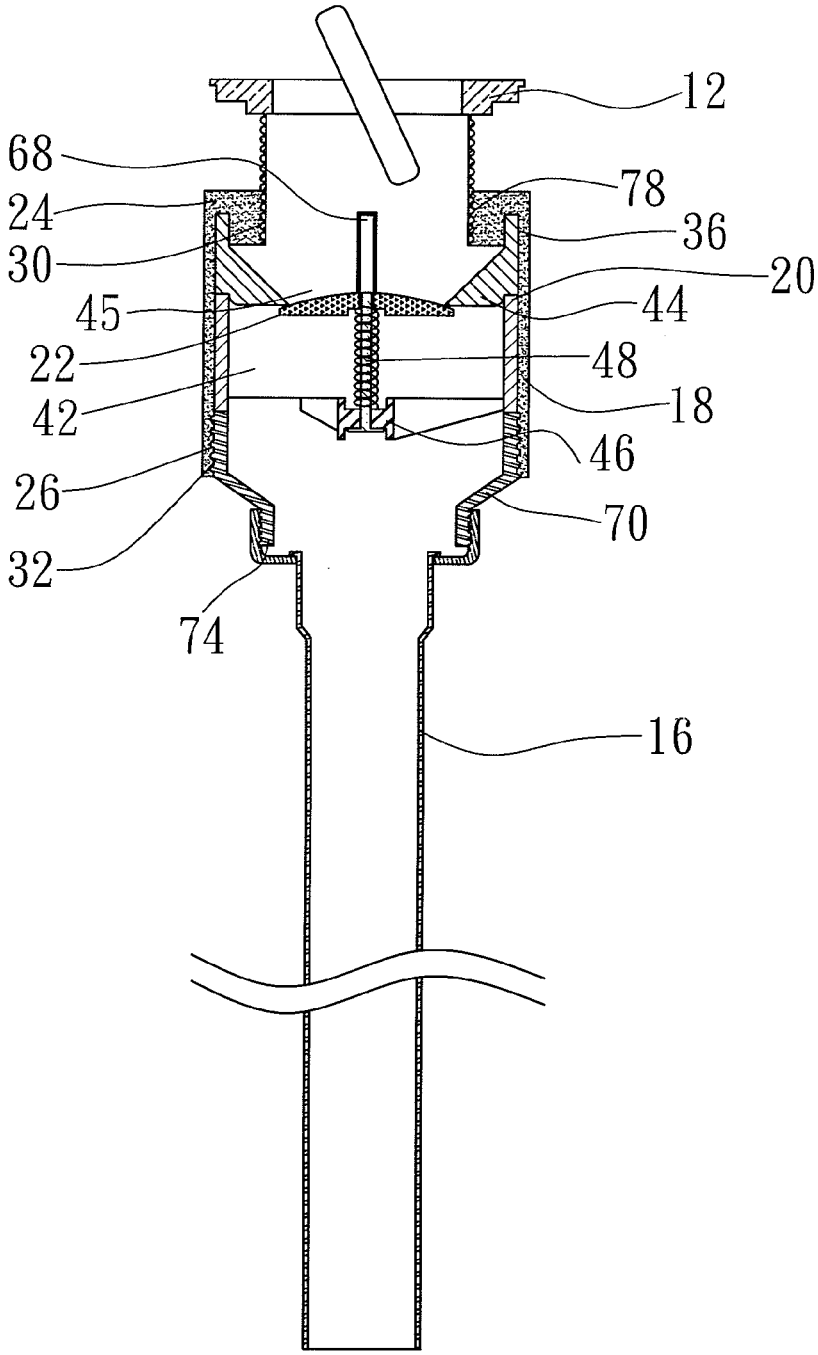
FIG. 6 shows a cross sectional view similar to FIG. 5, with the closure device applied to a drainpipe of a washbasin.
Figure 7:
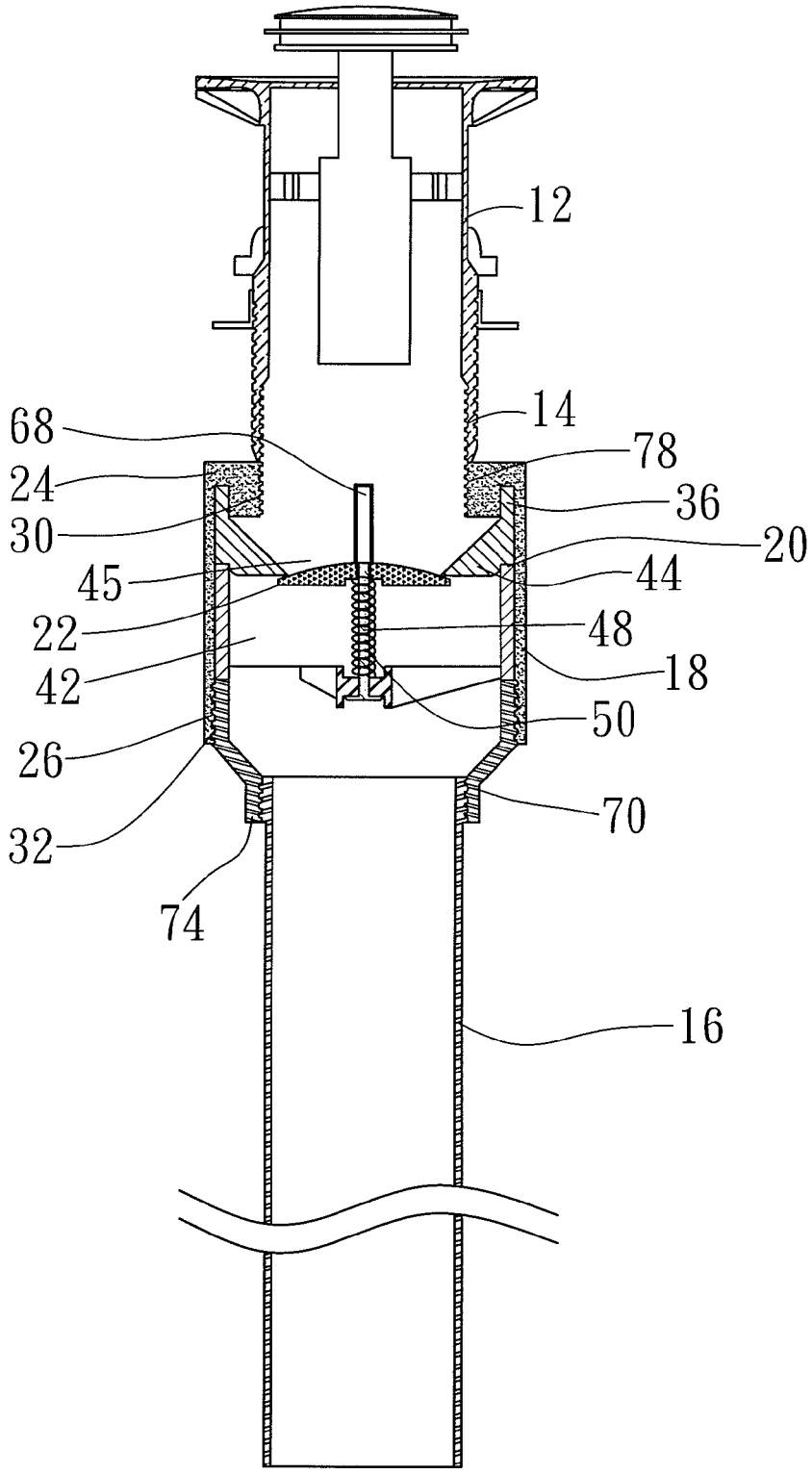
FIG. 7 shows a cross sectional view similar to FIG. 6, with the closure device applied to a drainpipe of another type of washbasin.

FIGS. 6 and 7 show that closure device 10 can be installed between drain 12 and drainpipe 16 of different types of washbasins, wherein upper connector 78 of closure device 10 is connected with washbasin drain 12, and lower connector 70 is connected with washbasin drainpipe 16.

Figure 8:
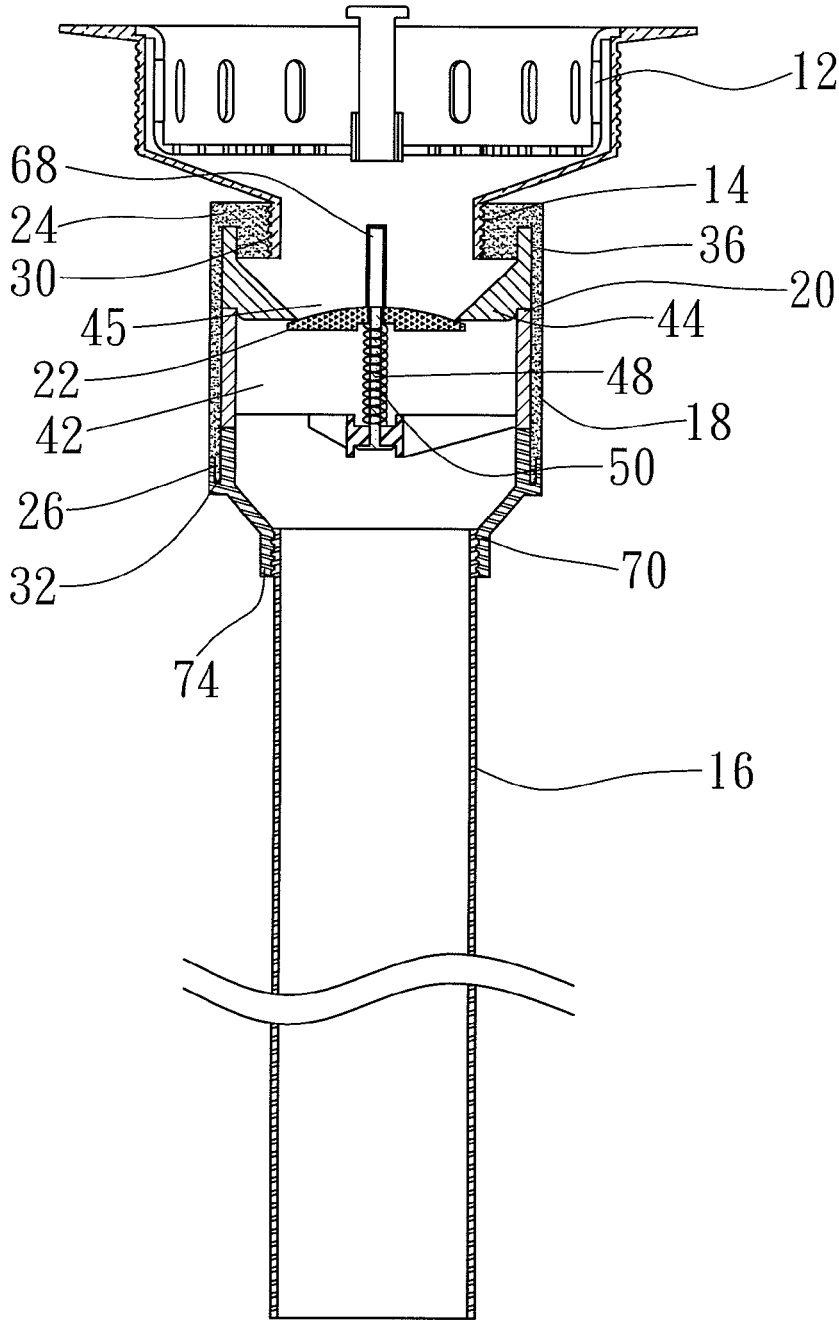
FIG. 8 shows another cross sectional view similar to FIG. 3, with a lower connector fitted to a lower end of an outer sleeve.

It can be appreciated that the connection between lower connector 70 and lower end 26 of outer sleeve 18 is not limited to a thread connection. FIG. 8 shows that lower connector 70 is fitted with lower end 26 of outer sleeve 18. Alternatively, lower connector 70 can be integrally formed with lower end 26 of outer sleeve 18.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A closure device for a drain pipeline comprising:

an outer sleeve including upper and lower ends spaced in a vertical direction, with the upper end of the outer sleeve having an upper coupling opening for connecting with a drain of a sink or washbasin, with the lower end of the outer sleeve having a lower coupling opening for connecting with a drainpipe;

an inner sleeve installed within the outer sleeve and including upper and lower sections spaced in the vertical direction, with the upper section of the inner sleeve having an inner flange formed on an inner periphery of the upper section of the inner sleeve, with the inner flange defining a flow port, with the inner sleeve provided with a spring seat, a guide, and a spring, with the spring seat mounted in the lower section of the inner sleeve, with the guide extending from the spring seat toward the upper section of the inner sleeve in the vertical direction, with the spring mounted around the guide and including top and lower ends spaced in the vertical direction, with the lower end of the spring abutting against the spring seat; and a closure member received in the inner sleeve and including a closure portion and a tube portion extending upwards from the closure portion in the vertical direction, with the closure portion located between the spring seat and the inner flange of the inner sleeve, with the closure portion abutting against the upper end of the spring, with the tube portion mounted around an upper end of the guide, with the closure member being moveable between a first position and a second position in the vertical direction, with the closure portion biased by the spring to close the flow port when the closure member is in the first position, and with the closure portion spaced from the inner flange to open the flow port when the closure member is in the second position.

2. The closure device according to claim 1, further comprising a tubular lower connector, with the lower connector including an upper end having an outer thread, with the lower coupling opening of the outer sleeve having an inner thread, and with the upper end of the lower connector threadedly coupled with the lower coupling opening of the outer sleeve and abutting the lower section of the inner sleeve.

3. The closure device according to claim 2, with the upper and lower sections of the inner sleeve being a sleeve body respectively and detachably coupled with each other to form the inner sleeve, with the upper end of the outer sleeve including an annular groove formed between an outer periphery of the upper end of the outer sleeve and the upper coupling opening of the outer sleeve, and with the upper section of the inner sleeve engaged in the annular groove of the outer sleeve.

4. The closure device according to claim 3, further comprising a tubular upper connector, with the upper connector including a lower end having an outer thread, with the upper coupling opening of the outer sleeve having an inner thread, and with the lower end of the upper connector threadedly coupled with the upper coupling opening of the outer sleeve.

5. The closure device according to claim 3, with the inner flange of the inner sleeve having conical cross sections, with the closure portion having an outer diameter larger than an outer diameter of the flow port, and with the guide being a screw and including a lower end engaged to the spring seat and an upper end located in the upper section of the inner sleeve.

* * * * *